US007025292B2

(12) United States Patent
Mohr

(10) Patent No.: US 7,025,292 B2
(45) Date of Patent: Apr. 11, 2006

(54) INJECTOR TO INJECT FUEL INTO A COMBUSTION CHAMBER

(75) Inventor: Markus Mohr, Roth (DE)

(73) Assignee: Siemens Aktiengesellschaft, Munich (DE)

( * ) Notice: Subject to any disclaimer, the term of this patent is extended or adjusted under 35 U.S.C. 154(b) by 297 days.

(21) Appl. No.: 10/435,234

(22) Filed: May 9, 2003

(65) Prior Publication Data

US 2003/0226912 A1 Dec. 11, 2003

Related U.S. Application Data

(63) Continuation of application No. PCT/DE01/04168, filed on Nov. 6, 2001.

(30) Foreign Application Priority Data

Nov. 10, 2000 (DE) ..... 100 55 639

(51) Int. Cl.

| | |
|---|---|
| ***F02M 59/00*** | (2006.01) |
| ***F02M 61/00*** | (2006.01) |
| ***F02M 63/00*** | (2006.01) |
| ***B05B 1/08*** | (2006.01) |
| ***B05B 3/04*** | (2006.01) |

(52) U.S. Cl. ..... 239/533.2; 239/102.2; 251/129.06; 123/498

(58) Field of Classification Search ..... 239/533.2–533.12, 585.1–585.5, 102.2; 251/129.06; 123/498, 470

See application file for complete search history.

(56) References Cited

U.S. PATENT DOCUMENTS

| | | | | | |
|---|---|---|---|---|---|
| RE27,896 | E | * | 1/1974 | Hansen et al. | 204/486 |
| 5,289,627 | A | * | 3/1994 | Cerny et al. | 29/602.1 |
| 5,577,666 | A | * | 11/1996 | Shen | 239/290 |
| 5,630,400 | A | | 5/1997 | Sumida et al. | 123/470 |
| 5,753,316 | A | * | 5/1998 | Brent et al. | 427/486 |
| 5,950,932 | A | * | 9/1999 | Takeda et al. | 239/585.4 |
| 6,003,792 | A | * | 12/1999 | Munezane et al. | 239/585.3 |
| 6,024,302 | A | * | 2/2000 | Sumida et al. | 239/585.5 |
| 6,231,413 | B1 | * | 5/2001 | Tsukamoto | 445/24 |

FOREIGN PATENT DOCUMENTS

| | | |
|---|---|---|
| DE | 198 21 768 A1 | 12/1999 |
| DE | 199 08 420 A1 | 5/2000 |
| DE | 198 56 617 A1 | 6/2000 |
| DE | 199 21 242 C1 | 10/2000 |
| GB | 1015412 | 12/1965 |
| JP | 1 562 629 | 12/1976 |

* cited by examiner

*Primary Examiner*—David A. Scherbel
*Assistant Examiner*—Darren Gorman
(74) *Attorney, Agent, or Firm*—Baker Botts L.L.P.

(57) ABSTRACT

An injector housing (1) of the injector has an indentation (2) in which a part of an actuator housing (4) of the injector is located. A floor of said indentation (2) is formed by a peripheral support surface (3) for the actuator housing (4). A bottom surface of the actuator housing (4) is oriented towards the support surface (3) and has a peripheral recess (11). This recess (11) is such that the bottom surface of the actuator housing (4) has at least one peripheral projection (12), which is oriented towards the support surface (3) and is adjacent to the support surface (3). A seal (13) for preventing leakage along interfaces between the injector housing (1) and the actuator housing (4) is locate din the recess (11) and is adjacent to the support surface (3).

20 Claims, 2 Drawing Sheets

PRIOR ART

INJECTOR TO INJECT FUEL INTO A COMBUSTION CHAMBER

CROSS REFERENCE TO RELATED APPLICATION

This application is a continuation of copending International Application No. PCT/DE01/04168 filed Nov. 6, 2001, which designates the United States, and claims priority to German application number 10055639.6 filed Nov. 10, 2000.

TECHNICAL FIELD OF THE INVENTION

The invention relates to an injector for injecting fuel into a combustion chamber.

BACKGROUND OF THE INVENTION

An injector of this type generally features an actuator that controls an injection valve. If the injection valve is opened by the actuator fuel is injected into a combustion chamber. For example the actuator operates a servo valve which in its turn hydraulically opens and closes the injection valve. The actuator can be activated electrically. For example the actuator consists of piezo-electric elements and expands when an electrical voltage is applied.

The structure of a typical injector is described on the basis of FIG. 1 that shows a cross section of a part of an injector with an actuator housing, a seal, a projection, a recess, an indentation, a support surface, a further indentation, a valve piston, a valve head, a control chamber and an injector housing. The actuator 10' is normally located in an actuator housing 4', whereas the injection valve (not shown) and/or the servo valve, typically comprising a valve piston 6' and a valve head 7', are located in an injector housing 1'. Valve head 7' separates a control chamber 8' from a return line 15'. The injector housing 1' features an indentation 2' into which a part of the actuator housing 4' is inserted. Indentation 2' of injector housing 1' features a first bottom surface that is designed as a surrounding support surface 3' for actuator housing 4'. In the middle of this indentation 2' there is a further indentation 5', in which the servo valve and/or the injection valve are located. After actuator housing 4' is pushed into injector housing 1', actuator 10' can activate the valve assembly accommodated in further indentation 5' that surrounds the servo valve and the injection valve. A longitudinal expansion of actuator 10' pushes valve piston 6' in the direction of valve head 7' and lifts the latter up from its valve seat against the force of a spring 9'. The fall in pressure in control chamber 8' causes hydraulic opening of the injection valve.

For precise setting of the idle stoke between actuator 10' and the valve assembly there is a suitable adjustment shim E' located on support surface 3' of injector housing 1'.

So that fuel that is in the valve assembly cannot flow along the interfaces between the injector housing 1' and the actuator housing 4' a seal 13' is provided between injector housing 1' and actuator housing 4'. To this end, the actuator housing 4' features a peripheral recess 11' on its side surface, in which seal 13', typically an O-ring seal, is located. Because of recess 11', actuator housing 4' features a projection 12' that is oriented to the side.

The seal is stretched around the actuator housing. The actuator housing is then inserted into the injector housing. When this is done the seal rubs against the side walls of the indentation of the injector housing. This represents a particular disadvantage if the indentation is to be coated with a corrosion protection layer. It has become evident that the friction between the seal and the corrosion protection layer is so great that either the actuator housing cannot be inserted into the injector housing or the seal is destroyed when the actuator housing is pushed into the injector housing.

SUMMARY OF THE INVENTION

The object of the invention is to specify an injector to inject fuel into a combustion chamber in which it is possible to incorporate a corrosion protection layer in the indentation of the injector housing and at the same time prevent leakage along the interfaces between the injector housing and the actuator housing.

The problem is resolved by an injector to inject fuel into a combustion chamber with the following features. The injector features an actuator housing and an injector housing. The injector housing features an indentation in which part of the actuator housing is located. A bottom surface of the indentation of the injector housing is formed by a surrounding support surface for the actuator housing. A seal is located between the injector housing and the actuator housing to prevent leakage along interfaces between the injector housing and the actuator housing. An underside of the actuator housing that is adjacent to the support surface of the injector housing features a peripheral recess. The recess of the underside of the actuator housing is such that the underside of the actuator housing has at least one peripheral projection which is oriented towards the support surface of the injector housing and is adjacent to the support surface of the injector housing. The seal is located in the recess on the underside of the actuator housing and stretched around the projection of the underside of the actuator housing. The seal is adjacent to the support surface of the injector housing.

Since the seal is located on the underside of the actuator housing and not on side surfaces of the actuator housing, there is no contact between the seal and the side surfaces of the indentation, so that the actuator housing can be introduced into the indentation without friction between the seal and the indentation. In consequence the indentation can be coated with a corrosion protection layer, whereas because of the presence of the seal leakage along the interfaces between the injector housing and the actuator housing is prevented.

The seal can also be fitted into the recess significantly more easily than before since the seal does not have to be stretched over a projection extending sideways which requires increased extension of the seal.

The actuator housing rests directly with its projection on the support surface of the injector housing. There is no need for the normal adjustment shims between the actuator housing and the injector housing on the support surface since otherwise the seal is only effective between the actuator housing and the adjustment shim so that leakage can occur between the adjustment shim and the injector housing.

The idle stroke of the injector, which is determined by the gap between the actuator in its non-activated state and the valve assembly, can also be set exactly without an adjustment shim. Typically the injector features a servo valve consisting of a valve piston and a valve head. The valve head separates a control chamber from a return line. The valve head is typically pressed against its seat by a spring located in the control chamber. The valve piston is located outside the control chamber, and is in contact with the valve head. The valve piston is located in a further indentation extending from the indentation of the injector housing in such a way that a longitudinal extension of the actuator leads to a displacement of the valve piston. The displacement of the valve piston results in the valve head being lifted from its seat against the force of the spring. The gap between the support surface of the injector housing and the surface of the valve head adjacent to the control chamber is typically measured to set the idle stroke of the injector. Depending on this gap, the length of the valve piston for a prespecified idle stroke is determined. The valve piston is selected so that it has the required length and is subsequently inserted into the injector housing.

The actuator housing is then pushed into the indentation of the injector housing.

The recess on the underside of the actuator housing can be designed in such a way that the underside of the actuator housing features two projections: An inner projection and an outer one that surrounds the inner projection. In this case the seal is located between the inner projection and the outer projection.

Preferably however the recess on the underside of the actuator housing is such that the underside of the actuator housing only features one peripheral projection around which the seal is tensioned. In this case there is no outer projection.

With this type of injector the seal can be fitted more easily into the recess. A further advantage is that the indentation of the injector housing can be manufactured with less effort, as will be explained below. For the creation of the indentation the groove edge of the injector housing is initially chamfered between the side walls of the indentation and the support surface of the injector housing. An actuator housing with non-chamfered edges cannot be introduced into such an indentation up to the support surface of the injector housing. Further work must be done on the indentation beforehand by widening the groove edges so that the edges of the actuator housing fit into the widened groove edges. It is possible to dispense with this additional measure if the recess on the underside of the actuator housing is such that the underside features only one peripheral projection. In this case the outer problem edge of the actuator housing is not actually present at all. What is involved here is a sharp chamfering of the edge. The indentation of the injector housing can consequently be manufactured with less effort. Over and above this a widening of the groove edge of the injector housing is also disadvantageous for the resistance of the injector to high pressure since increased notch stresses occur.

Preferably the indentation of the injector housing is coated with a corrosion protection layer. The corrosion protection layer typically consists of Zinc phosphate.

The seal can basically consist of an elastomer; such as fluorocarbon rubber.

So that the seal does not slip out of the recess in the underside of the actuator housing before the actuator housing is inserted into the injector housing, it is advantageous for the projection to be designed in such a way that its surface adjacent to the side surface of the indentation of the injector housing is at an angle. The angle here is such that the projection in the area of the support surface of the injector housing is closer to the side surfaces of the indentation than in the area of its shoulder.

DETAILED DESCRIPTION OF THE PREFERRED EMBODIMENT

Figure 1:
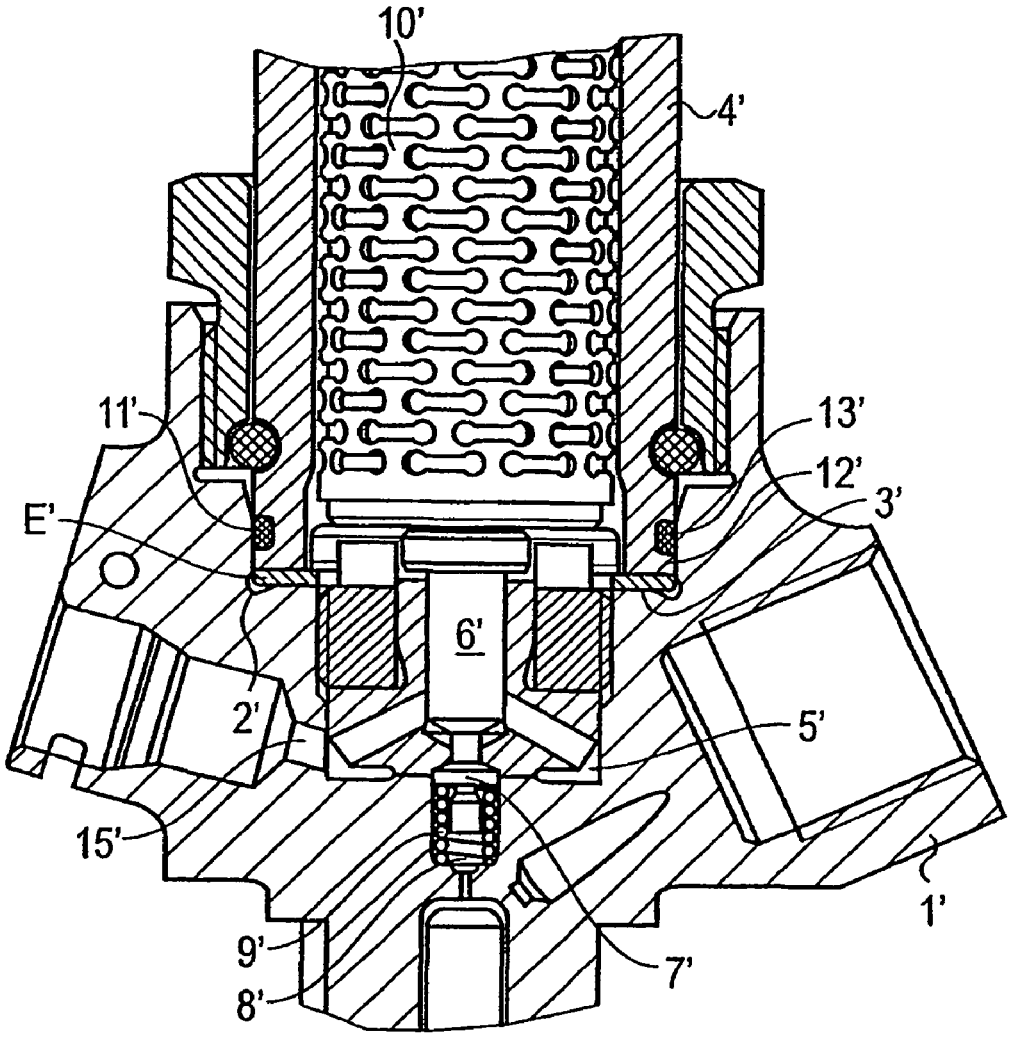
FIG. 1 shows the structure of a typical injector.
Figure 2:
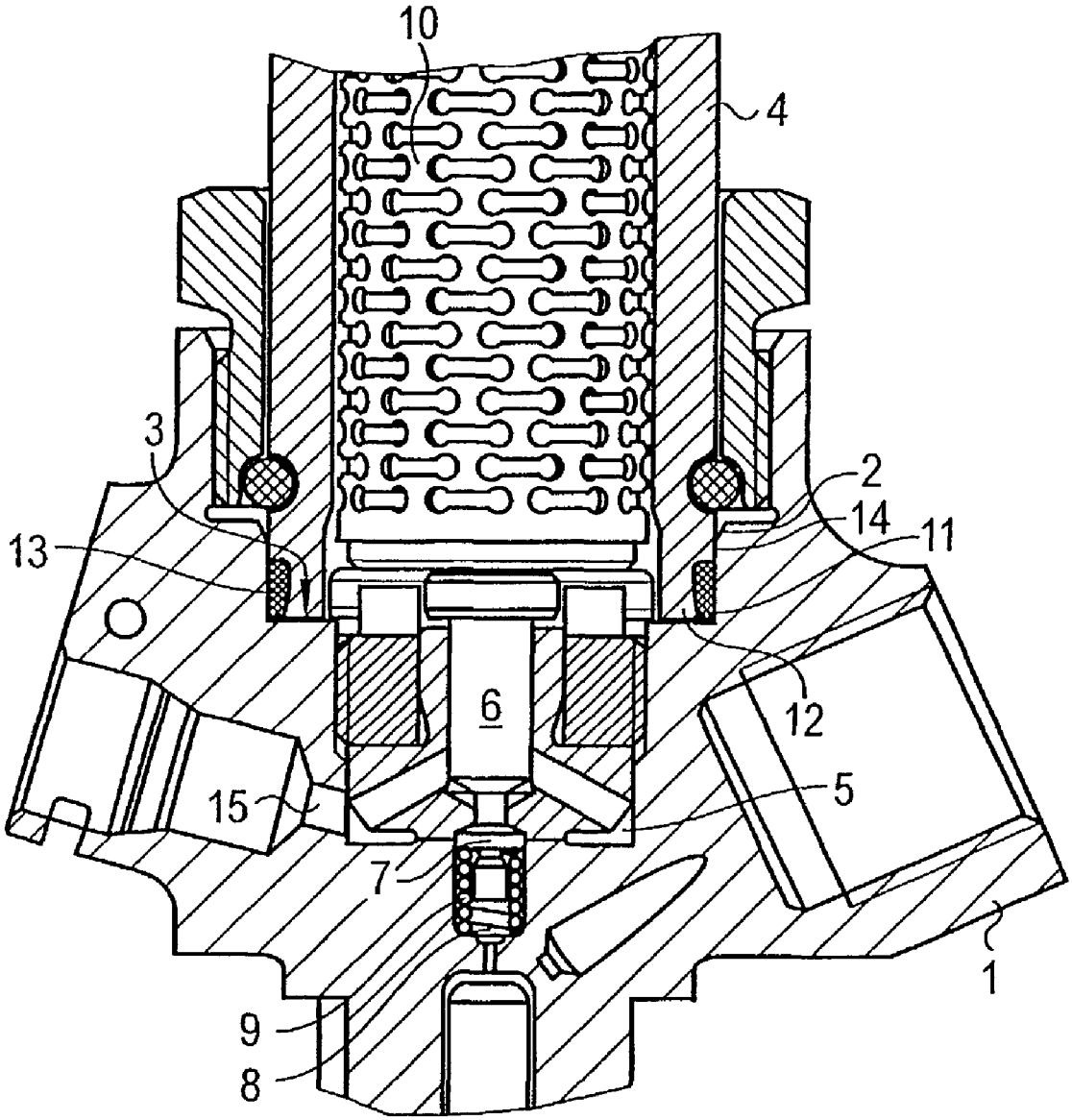
FIG. 2 shows an exemplary embodiment of the invention.

FIG. 2 shows a cross section through a part of an injector with an actuator, an actuator housing, a seal, a projection, a recess, an indentation, a support surface, a further indentation, a valve piston, a valve head, a control chamber and an injector housing.

The injector features an injector housing 1 with an indentation 2. The indentation 2 of the injector housing 1 is coated with an appr. 2–3 μm thick corrosion protection layer 14. Corrosion protection layer 14 consists of zinc phosphate.

A bottom surface of indentation 2 of injector housing 1 is formed by a peripheral support surface 3 for an actuator housing 4. In the middle of indentation 2 injector housing 1 features a further indentation 5. In the further indentation 5 a valve piston 6 and a valve head 7 are located which are in contact with each other. Valve head 7 separates a control chamber 8 from a return line 15. Valve head 7 is pressed into its valve seat by a spring 9 located in control chamber 8. A part of actuator housing 4 is located in indentation 2 of injector housing 1.

A piezo-electric actuator 10 is located in actuator housing 4. Actuator 10 is located relative to valve piston 6 in such a way that for a longitudinal expansion of actuator 10 through application of a voltage, a force is exerted on valve piston 6 so that valve piston 6 moves downwards in the direction of valve head 7 and lifts valve head 7 from its seat. On its underside, which is adjacent to support surface 3 of injector housing 1, actuator housing 4 features a peripheral recess 11. This recess 11 is such that the underside of actuator housing 4 features precisely one peripheral projection 12 which is oriented to support surface 3 of injector housing 1 and adjoins support surface 3 of injector housing 1. Projection 12 of the underside of actuator housing 4 features a side surface adjacent to the side surface of indentation 2 of injector housing 1, that is angled. This means that projection 12 of the underside of actuator housing 4 widens in the direction of support surface 3 of injector housing 1.

A seal 13 in the form of a ring is located in recess 11 of the underside of actuator housing 4 and stretched around projection 12. Seal 13 is located between actuator housing 4 and injector housing 1 in such a way that it adjoins support surface 3 of injector housing 1. Seal 13 consists of fluorocarbon rubber.

If valve head 7 is lifted from its seat by activation of actuator 10, the pressure of the fuel in control chamber 8 drops. This hydraulically lifts an injection valve, not shown, from its seat so that fuel Is injected into a combustion chamber.

The invention claimed is:

1. Injector to inject fuel into a combustion chamber comprising an actuator housing and an injector housing, wherein the injector housing comprises an indentation in which a part of the actuator housing is located, a bottom surface of the indentation of the injector housing is formed by a peripheral support surface for the actuator housing, a seal is located between the injector housing and the actuator housing to prevent leakage along interfaces between injector housing and actuator housing, an underside of the actuator housing that is adjacent to the support surface of the injector housing comprises a peripheral recess, the recess of the underside of actuator housing is such that the underside of actuator housing comprises at least one peripheral projection which is oriented towards the support surface of the injector housing and is adjacent to the support surface of the injector housing, the diameter of the peripheral projection at a beginning of the peripheral projection being smaller than the diameter at a proximate end of the peripheral projection, and wherein the seal is located in the recess of the underside of the actuator housing and is stretched around the projection of the underside of the actuator housing and adjoins the support surface of the injector housing.

2. The injector according to claim 1, wherein the recess of the underside of the actuator housing is such that the underside of the actuator housing comprises a single peripheral projection around which the seal is stretched.

3. The injector according to claim 1, wherein the indentation of the injector housing is coated with a corrosion protection layer.

4. The injector according to claim 3, wherein the corrosion protection layer basically consists of zinc phosphate.

5. The injector according to claim 1, wherein the seal basically consists of an elastomer.

6. The injector according to claim 1, wherein a side surface of the projection adjoining the side surface of the indentation of the injector housing of the underside of the actuator housing is designed angled so that the shoulder of the projection is located further away from the side surface of the indentation than a part of the projection adjoining the support surface of the injector housing.

7. Injector to inject fuel into a combustion chamber comprising an actuator housing and an injector housing, wherein the injector housing features an indentation in which a part of the actuator housing is located, a bottom surface of the indentation of the injector housing is formed by a peripheral support surface for the actuator housing, a seal is located between the injector housing and the actuator housing to prevent leakage along interfaces between the injector housing and the actuator housing, an underside of the actuator housing that adjoins the support surface of the injector housing features a peripheral recess, the recess of the underside of the actuator housing is such that the underside of the actuator housing features at least one peripheral projection which is oriented towards the support surface of the injector housing and adjoins the support surface of the injector housing, the seal is located in a recess of the underside of the actuator housing and is stretched around the projection of the underside of the actuator housing and adjoins the support surface of the injector housing, the recess of the underside of the actuator housing is such that the underside of the actuator housing features a single peripheral projection around which the seal is stretched, and wherein a side surface of the projection adjoining the side surface of the indentation of the injector housing of the underside of the actuator housing is designed angled so that the shoulder of projection is located further away from the side surface of the indentation than a part of the projection adjoining the support surface of the injector housing.

8. The injector according to claim 7, wherein the indentation of the injector housing is coated with a corrosion protection layer.

9. The injector according to claim 8, wherein the corrosion protection layer basically consists of zinc phosphate.

10. The injector according to claim 7, wherein the seal basically consists of an elastomer.

11. Injector to inject fuel into a combustion chamber comprising:

an actuator housing, an injector housing comprising an indentation in which a part of the actuator housing is located, wherein a bottom surface of the indentation of the injector housing is formed by a peripheral support surface for the actuator housing, an underside of the actuator housing that is adjacent to the support surface of the injector housing comprises a peripheral recess, whereby the underside of the actuator housing comprises at least one peripheral projection which is oriented towards the support surface of the injector housing and is adjacent to the support surface of the injector housing, the diameter of the peripheral projection at a beginning of the peripheral projection being smaller than the diameter at a proximate end of the peripheral projection, and a seal located between the injector housing and the actuator housing in the recess of the underside of the actuator housing and which is stretched around the projection of the underside of the actuator housing and adjoins the support surface of the injector housing.

12. The injector according to claim 11, wherein the recess of the underside of the actuator housing is such that the underside of the actuator housing comprises a single peripheral projection around which the seal is stretched.

13. The injector according to claim 11, wherein the indentation of the injector housing is coated with a corrosion protection layer.

14. The injector according to claim 13, wherein the corrosion protection layer basically consists of zinc phosphate.

15. The injector according to claim 11, wherein the seal basically consists of an elastomer.

16. The injector according to claim 11, wherein a side surface of the projection adjoining the side surface of the indentation of the injector housing of the underside of the actuator housing is designed angled so that the shoulder of the projection is located further away from the side surface of the indentation than a part of the projection adjoining the support surface of the injector housing.

17. Injector to inject fuel into a combustion chamber comprising:

an actuator housing;

an injector housing comprising an indentation in which a part of the actuator housing is located, wherein a bottom surface of the indentation of the injector housing is formed by a peripheral support surface for the actuator housing, a peripheral recess formed in the underside of the actuator housing, wherein the underside of the actuator housing comprises a single peripheral projection around which the seal is stretched, a seal located between the injector housing and the actuator housing in a recess of the underside of the actuator housing, which is stretched around the projection of the underside of the actuator housing and adjoins the support surface of the injector housing, and wherein a side surface of the projection adjoining the side surface of the indentation of the injector housing of the underside of the actuator housing is designed angled so that the shoulder of projection is located further away from the side surface of the indentation than a part of the projection adjoining the support surface of the injector housing.

18. The injector according to claim 17, wherein the indentation of the injector housing is coated with a corrosion protection layer.

19. The injector according to claim 18, wherein the corrosion protection layer basically consists of zinc phosphate.

20. The injector according to claim 17, wherein the seal basically consists of an elastomer.

* * * * *